US010895829B1

(12) United States Patent
Kuwabara et al.

(10) Patent No.: US 10,895,829 B1
(45) Date of Patent: Jan. 19, 2021

(54) IMAGE FORMING APPARATUS

(71) Applicant: FUJI XEROX Co., Ltd., Tokyo (JP)

(72) Inventors: Jun Kuwabara, Kanagawa (JP); Yoshiyuki Tominaga, Kanagawa (JP); Masaaki Yamamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/855,486

(22) Filed: Apr. 22, 2020

(30) Foreign Application Priority Data

Nov. 28, 2019 (JP) ..... 2019-215747

(51) Int. Cl.

| | |
|---|---|
| ***G03G 15/00*** | (2006.01) |
| ***G03G 15/16*** | (2006.01) |
| ***G03G 15/01*** | (2006.01) |
| ***G03G 21/14*** | (2006.01) |

(52) U.S. Cl.
CPC ..... *G03G 15/161* (2013.01); *G03G 15/0115* (2013.01); *G03G 15/5016* (2013.01); *G03G 15/6591* (2013.01); *G03G 15/6594* (2013.01); *G03G 21/14* (2013.01); *G03G 2215/0122* (2013.01)

(58) Field of Classification Search
CPC ..... G03G 15/0115; G03G 15/161; G03G 15/5061; G03G 15/6591; G03G 15/6594; G03G 21/14; G03G 2215/751
USPC ..... 399/38–40, 42, 45, 46, 49
See application file for complete search history.

(56) References Cited

U.S. PATENT DOCUMENTS

| | | | | |
|---|---|---|---|---|
| 7,283,756 | B2 * | 10/2007 | Suzuki | G03G 15/0131 399/27 |
| 8,023,840 | B2 * | 9/2011 | Shirafuji | G03G 15/1645 399/31 |
| 9,609,174 | B2 * | 3/2017 | Matsuoka | H04N 1/6072 |

FOREIGN PATENT DOCUMENTS

| | | | |
|---|---|---|---|
| JP | 2006-221106 | A | 8/2006 |
| JP | 2006-251138 | A | 9/2006 |
| JP | 6340927 | B2 | 6/2018 |

* cited by examiner

*Primary Examiner* — Hoan H Tran
(74) *Attorney, Agent, or Firm* — Sughrue Mion, PLLC

(57) ABSTRACT

An image forming apparatus includes an image holding unit that holds an image that is formed of a developer, the image being intended to be transferred onto a medium, and an image that is not intended to be transferred onto a medium, a transfer unit that transfers the image that is intended to be transferred onto a medium onto a medium, and a forming unit that forms, upon receiving a print instruction to form the image that is intended to be transferred onto a medium onto the image holding unit, the image that is not intended to be transferred onto a medium at a position on the image holding unit where the image that is intended to be transferred onto a medium is to be formed.

19 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2019-215747 filed Nov. 28, 2019.

BACKGROUND

(i) Technical Field

The present disclosure relates to an image forming apparatus.

(ii) Related Art

The technologies described in the following Patent Documents are known examples of a technology for forming an image that is not intended to be transferred onto a medium, the technology being employed in image forming apparatuses such as copying machines, printers, or facsimile machines.

Japanese Patent No. 6340927 (the Claims, [0038]-[0053], FIG. 6) describes a technology for forming a toner image that has a belt-like shape in a non-image region between toner images in order to forcibly use a toner that has deteriorated as a result of being stirred in a developing device without being used. In the technology described in Japanese Patent No. 6340927, when the width of a recording medium is smaller than a maximum width dimension, a large amount of a deteriorated toner is used by increasing the image density of a toner image having a belt-like shape or by increasing the length of an image.

Japanese Unexamined Patent Application Publication No. 2006-251138 ([0043]-[0050], FIG. 4) describes a technology for adjusting the density of a toner band when the toner band is formed in a region excluding an image forming region by reducing the density of the toner band when a printed image is dark and increasing the density of the toner band when the printed image is light such that a fixed amount of a toner is supplied to a cleaning device.

Japanese Unexamined Patent Application Publication No. 2006-221106 (the Claims, [0023]-[0032], FIG. 2) describes a technology for forming a toner band on a photoconductor drum on which image formation is not performed in a monochromatic-image forming mode and maximizing the toner amount of a toner band formed on the most upstream photoconductor drum in order to maintain the lubricity of a cleaning blade.

SUMMARY

Aspects of non-limiting embodiments of the present disclosure relate to suppressing occurrence of a failure in transferring an image onto a medium compared with the case where an image that is not intended to be transferred onto a medium is not formed before an image that is intended to be transferred onto a medium is formed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image holding unit that holds an image that is formed of a developer, the image being intended to be transferred onto a medium, and an image that is not intended to be transferred onto a medium, a transfer unit that transfers the image that is intended to be transferred onto a medium onto a medium, and a forming unit that forms, upon receiving a print instruction to form the image that is intended to be transferred onto a medium onto the image holding unit, the image that is not intended to be transferred onto a medium at a position on the image holding unit where the image that is intended to be transferred onto a medium is to be formed.

BRIEF DESCRIPTION OF THE DRAWINGS

Exemplary embodiments of the present disclosure will be described in detail based on the following figures, wherein.

DETAILED DESCRIPTION

Figure 1:
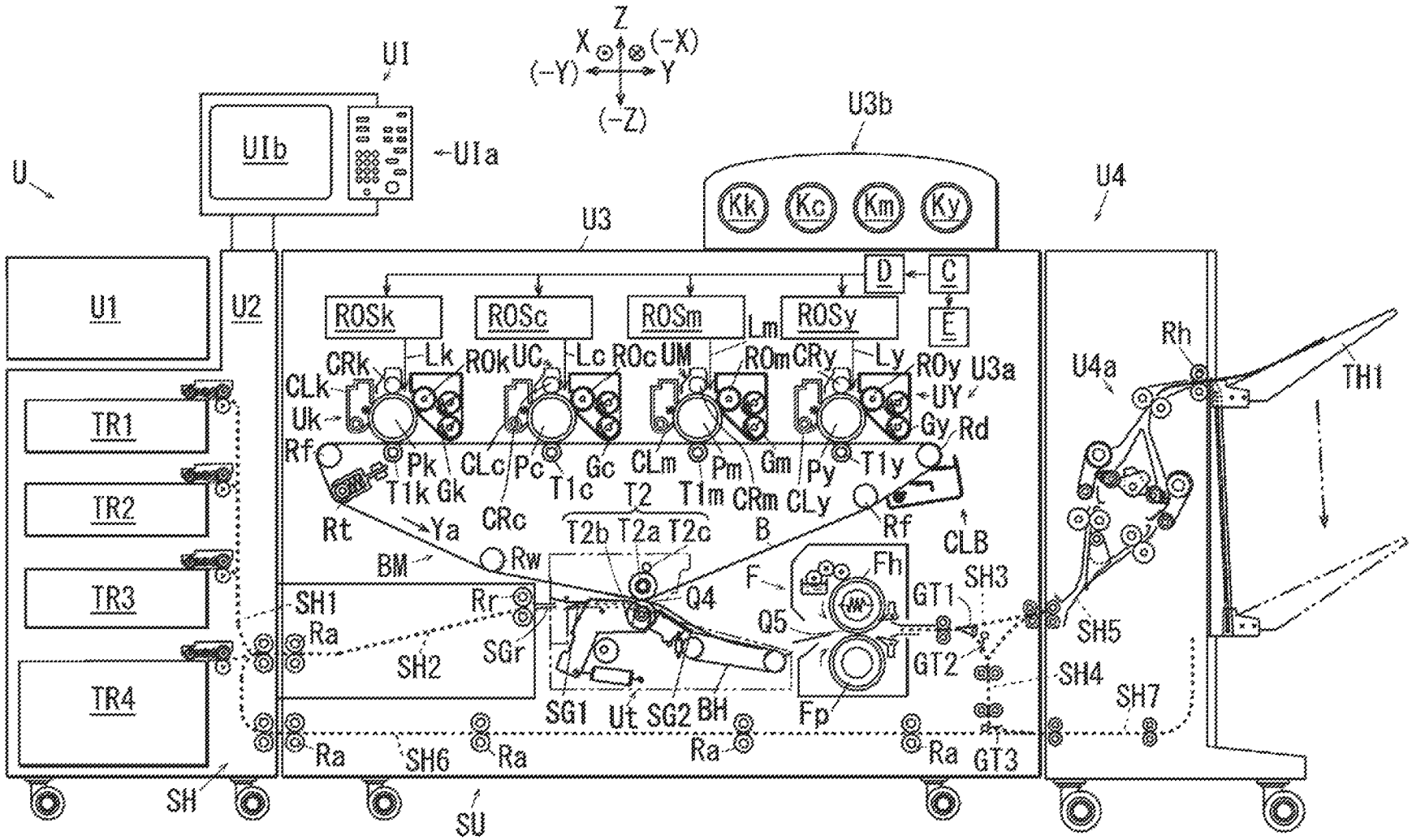
FIG. 1 is an overall view illustrating an image forming apparatus according to a first exemplary embodiment.

Although exemplary embodiments of the present disclosure will be described below as specific examples with reference to the drawings, the present disclosure is not limited to the following exemplary embodiments.

For ease of understanding of the following description, in the drawings, a front-rear direction, a left-right direction, and a top-bottom direction are respectively defined as the X-axis direction, the Y-axis direction, and the Z-axis direction, and directions or sides indicated by arrows X, −X, Y, −Y, Z, and −Z are respectively defined as a forward direction, a backward direction, a right direction, a left direction, an upward direction, and a downward direction or a front side, a rear side, a right side, a left side, a top side, and a bottom side.

An arrow extending from the rear side to the front side in the drawings is denoted by an encircled dot, and an arrow extending from the front side to the rear side in the drawings is denoted by an encircled cross.

In the following description, which refers to the drawings, descriptions of components that are not necessarily illustrated are suitably omitted for ease of understanding.

First Exemplary Embodiment

FIG. 1 is an overall view illustrating an image forming apparatus according to a first exemplary embodiment.

Figure 2:
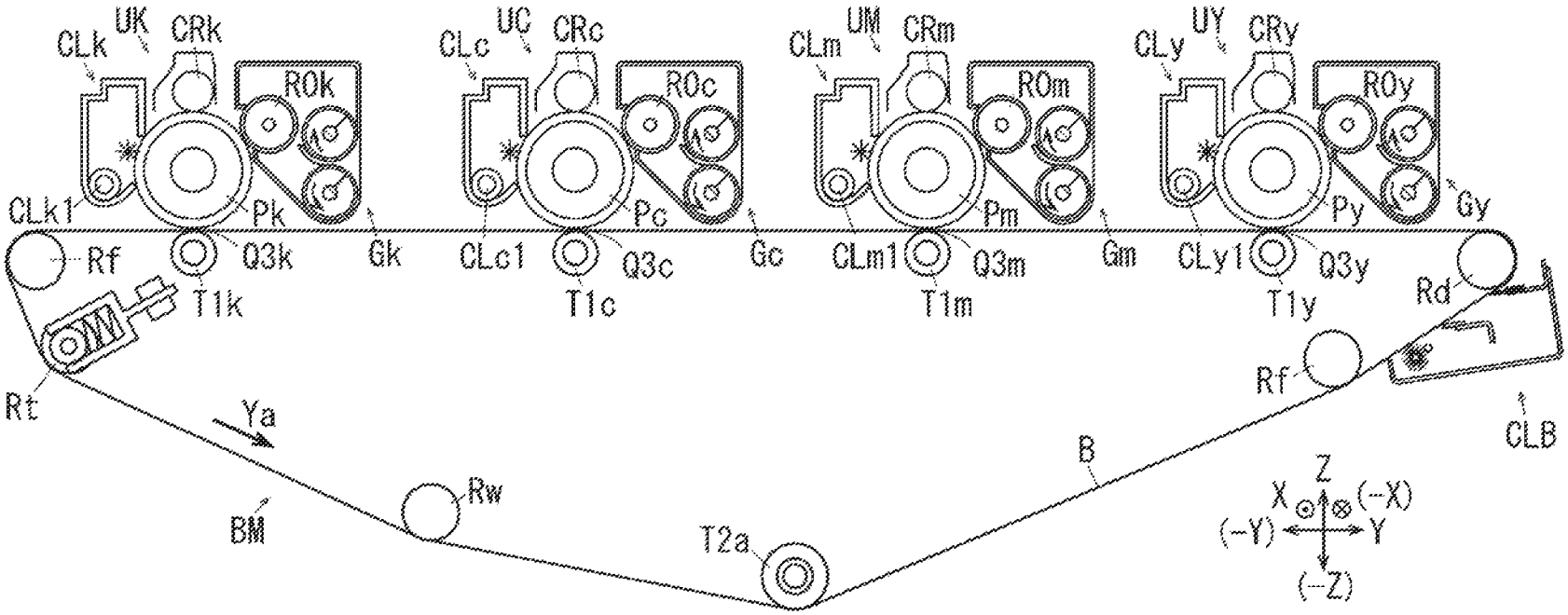
FIG. 2 is an enlarged view illustrating a visible-image forming device according to the first exemplary embodiment.

FIG. 2 is an enlarged view illustrating a visible-image forming device according to the first exemplary embodiment.

In FIG. 1, a copying machine U, which is an example of an image forming apparatus, includes a user interface UI, which is an example of an operation unit, a scanner unit U1, which is an example of an image reading device, a feeder unit U2, which is an example of a media-supply device, an image forming unit U3, which is an example of an image recording device, and a media processing device U4.

(Description of User Interface UI)

The user interface UI includes input buttons UIa that are used for, for example, starting a copying operation or setting the number of sheets to be copied. The user interface UI further includes a display UIb that displays contents that are input through the input buttons UIa and the state of the copying machine U.

(Description of Feeder Unit U2)

In FIG. 1, the feeder unit U2 includes a plurality of sheet-feeding trays TR1, TR2, TR3, and TR4, each of which is an example of a media container. The feeder unit U2 further includes a media supply path SH1, and recording sheets S, each of which is an example of an image recording medium and each of which is accommodated in one of the sheet-feeding trays TR1 to TR4, are taken out and transported along the media supply path SH1 to the image forming unit U3.

(Description of Image Forming Unit U3 and Media Processing Device U4)

In FIG. 1, the image forming unit U3 includes an image recording unit U3*a* that performs, on the basis of a document image read by the scanner unit U1, an image recording operation on one of the recording sheets S that is transported from the feeder unit U2.

In FIG. 1 and FIG. 2, a driving circuit D for latent-image forming devices ROSy, ROSm, ROSc, and ROSk outputs, on the basis of image information that is input from the scanner unit U1, driving signals corresponding to the image information to the latent-image forming devices ROSy to ROSk at a predetermined timing. The latent-image forming devices ROSy, ROSm, ROSc, and ROSk are included in the image forming unit U3 and correspond to colors of yellow (Y), magenta (M), cyan (C), and black (K), respectively. Photoconductor drums Py, Pm, Pc, and Pk, each of which is an example of an image carrier, are arranged below the latent-image forming devices ROSy to ROSk.

The surfaces of the photoconductor drums Py, Pm, Pc, and Pk that rotate are uniformly charged by charging rollers CRy, CRm, CRc, and CRk, each of which is an example of a charger. Electrostatic latent images are formed onto the charged surfaces of the photoconductor drums Py to Pk by laser beams Ly, Lm, Lc, and Lk, which are examples of latent-image writing light beams output by the latent-image forming devices ROSy, ROSm, ROSc, and ROSk. Electrostatic latent images formed on the surfaces of the photoconductor drums Py, Pm, Pc, and Pk are developed into toner images, which are examples of visible images of the colors Y, M, C, and K, by developing devices Gy, Gm, Gc, and Gk.

Note that the developing devices Gy to Gk are replenished with developers from toner cartridges Ky, Km, Kc, and Kk, each of which is an example of a developer container, after the developers have been used in a developing operation. The toner cartridges Ky, Km, Kc, and Kk are detachably mounted on a developer replenishing device U3*b*.

Toner images formed on the surfaces of the photoconductor drums Py, Pm, Pc, and Pk are sequentially transferred onto an intermediate transfer belt B, which is an example of an intermediate transfer body, in first transfer regions Q3*y*, Q3*m*, Q3*c*, and Q3*k* in such a manner as to be superposed with one another by first transfer rollers T1*y*, T1*m*, T1*c*, and T1*k*, each of which is an example of a first transfer unit, so that a color toner image, which is an example of a polychromatic visible image, is formed on the intermediate transfer belt B. The color toner image formed on the intermediate transfer belt B is transported to a second transfer region Q4.

Note that, in the case where there is only information regarding an image of color K, only the photoconductor drum Pk and the developing device Gk that correspond to color K are used, and only a toner image of color K is formed.

After completion of a first transfer process, residues such as residual developer and paper dust deposited on the surfaces of the photoconductor drums Py, Pm, Pc, and Pk are removed by drum cleaners CLy, CLm, CLc, and CLk, each of which is an example of an image-carrier cleaning unit.

In the first exemplary embodiment, the photoconductor drum Pk, the charging roller CRk, and the drum cleaner CLk are integrated with one another so as to form a photoconductor unit UK that corresponds to color K and that is an example of an image carrier unit. Similarly, a photoconductor unit UY corresponding to color Y includes the photoconductor drum Py, the charging roller CRy, and the drum cleaner CLy. A photoconductor unit UM corresponding to color M includes the photoconductor drum Pm, the charging roller CRm, and the drum cleaner CLm. A photoconductor unit UC corresponding to color C includes the photoconductor drum Pc, the charging roller CRc, and the drum cleaner CLc.

In addition, the photoconductor unit UK corresponding to color K and the developing device Gk that includes a developing roller R0*k*, which is an example of a developer holding unit, form a visible-image forming device UK+Gk that corresponds to color K. Similarly, the photoconductor unit UY corresponding to color Y and the developing device Gy that includes a developing roller R0*y* form a visible-image forming device UY+Gy that corresponds to color Y. The photoconductor unit UM corresponding to color M and the developing device Gm that includes a developing roller R0*m* form a visible-image forming device UM+Gm that corresponds to color M. The photoconductor unit UC corresponding to color C and the developing device Gc that includes a developing roller R0*c* form a visible-image forming device UC+Gc that corresponds to color C.

A belt module BM, which is an example of an intermediate transfer device, is disposed below the photoconductor drums Py to Pk. The belt module BM includes the intermediate transfer belt B, which is an example of an image holding unit, a driving roller Rd, which is an example of a driving member for an intermediate transfer body, a tension roller Rt, which is an example of a tension-applying member, a working roller Rw, which is an example of a member that prevents the intermediate transfer belt B from moving in a serpentine manner, a plurality of idle rollers Rf, each of which is an example of a driven member, a backup roller T2*a*, which is an example of an opposing member, and the above-mentioned first transfer rollers T1*y*, T1*m*, T1*c*, and T1*k*. The intermediate transfer belt B is supported in such a manner as to be move circularly in the direction of arrow Ya.

A second transfer unit Ut is disposed below the above-mentioned backup roller T2*a*. The above-mentioned second transfer unit Ut includes a second transfer roller T2*b*, which is an example of a second transfer member. The second transfer region Q4 is formed of a region in which the second transfer roller T2*b* is in contact with the intermediate transfer belt B. The backup roller T2*a*, which is an example of an opposing member, faces the second transfer roller T2*b* with the intermediate transfer belt B interposed therebetween. A contact roller T2*c*, which is an example of a power supplying member, is in contact with the backup roller T2*a*. A second transfer voltage having a polarity that is the same as the charge polarity of each of the toners is applied to the contact roller T2*c*.

The backup roller T2*a*, the second transfer roller T2*b*, and the contact roller T2*c* form a second transfer unit T2, which is an example of a transfer unit.

A media transport path SH2 is disposed below the belt module BM. One of the recording sheets S that has been fed along the media supply path SH1 of the feeder unit U2 is transported to registration rollers Rr, each of which is an example of a member that adjusts the timing of transportation, by transport rollers Ra, each of which is an example of a media transport member. The registration rollers Rr transport the recording sheet S toward the downstream side in accordance with the timing at which a toner image that has been formed on the intermediate transfer belt B is transported to the second transfer region Q4. The recording sheet S, which has been sent out by the registration rollers Rr, is guided by a sheet guide SGr, which is disposed on the side on which the registration rollers Rr are disposed, and a pre-transfer sheet guide SG1 and is transported to the second transfer region Q4.

The toner image on the intermediate transfer belt B is transferred onto the recording sheet S by the second transfer unit T2 when the toner image passes through the second transfer region Q4. Note that, in the case of a color toner image, toner images that have been transferred in the first transfer process to a surface of the intermediate transfer belt B in such a manner as to be superposed with one another are collectively transferred in a second transfer process onto the recording sheet S.

The first transfer rollers T1*y* to T1*k*, the second transfer unit T2, and the intermediate transfer belt B form a transfer device T1*y*-to-T1*k*+T2+B according to the first exemplary embodiment.

After completion of the second transfer process, the intermediate transfer belt B is cleaned by a belt cleaner CLB that is an example of a cleaning unit for an intermediate transfer body and that is disposed downstream from the second transfer region Q4. In the second transfer region Q4, the belt cleaner CLB, which is an example of a removing unit, removes residues such as residual developer that remains on the intermediate transfer belt B without being transferred and paper dust from the intermediate transfer belt B.

One of the recording sheets S to which a toner image has been transferred is guided by a post-transfer sheet guide SG2 and sent to a media transport belt BH, which is an example of a transport member. The media transport belt BH transports the recording sheet S to a fixing device F.

The fixing device F includes a heating roller Fh, which is an example of a heating member, and a pressure roller Fp, which is an example of a pressure member. The recording sheet S is transported to a fixing region Q5, which is a region in which the heating roller Fh and the pressure roller Fp are brought into contact with each other. When the recording sheet S passes through the fixing region Q5, the fixing device F applies heat and pressure to the toner image on the recording sheet S, and as a result, the toner image is fixed onto the recording sheet S.

The visible-image forming devices UY+Gy to UK+Gk, the transfer device T1*y*-to-T1*k*+T2+B, and the fixing device F form the image recording unit U3*a*, which is an example of an image forming unit according to the first exemplary embodiment.

A switching gate GT1, which is an example of a switching member, is disposed downstream from the fixing device F. The switching gate GT1 selectively switches between an ejection path SH3, which extends toward the media processing device U4, and a reverse path SH4 in such a manner that one of the recording sheets S that has passed through the fixing region Q5 is transported to the ejection path SH3 or the reverse path SH4. The recording sheet S that has been transported to the ejection path SH3 is transported to a sheet transport path SH5 of the media-processing device U4. A curl correction member U4*a*, which is an example of a curvature correction member, is disposed on the sheet transport path SH5. The curl correction member U4*a* corrects the curvature, or specifically, the curl of the recording sheet S that has been transported thereto. The recording sheet S whose curl has been corrected is ejected to an ejection tray TH1, which is an example of a media ejection unit, by ejection rollers Rh, each of which is an example of a media ejection member, in such a manner that a surface of the recording sheet S to which an image has been fixed (hereinafter referred to as an image fixed surface) faces upward.

The recording sheet S that has been transported by the switching gate GT1 to the side on which the reverse path SH4 of the image forming unit U3 is disposed passes through a second gate GT2, which is an example of a switching member, and is transported to the reverse path SH4 of the image forming unit U3.

In this case, when the recording sheet S is ejected in such a manner that the image fixed surface of the recording sheet S faces downward, after the trailing end of the recording sheet S in the transport direction has passed through the second gate GT2, the transport direction of the recording sheet S is reversed. Here, the second gate GT2 according to the first exemplary embodiment is formed of a thin-film-shaped elastic member. Accordingly, the second gate GT2 allows the recording sheet S, which has been transported to the reverse path SH4, to pass therethrough once. When the recording sheet S that has passed through the second gate GT2 is flipped over, or specifically, is switched back, the second gate GT2 guides the recording sheet S to the side on which the transport paths SH3 and SH5 are disposed. Then, the recording sheet S, which has been switched back, passes through the curl correction member U4*a* and is ejected to the ejection tray TH1 in a state where the image fixed surface of the recording sheet S faces downward.

A circulation path SH6 is connected to the reverse path SH4 of the image forming unit U3, and a third gate GT3, which is an example of a switching member, is disposed in a portion at which the reverse path SH4 and the circulation path SH6 are connected to each other. A downstream end of the reverse path SH4 is connected to a reverse path SH7 of the media-processing device U4.

One of the recording sheets S that has been transported to the reverse path SH4 through the switching gate GT1 is transported to the side on which the reverse path SH7 of the media-processing device U4 is disposed by the third gate GT3. Similar to the second gate GT2, the third gate GT3 according to the first exemplary embodiment is formed of a thin-film-shaped elastic member. Accordingly, the third gate GT3 allows the recording sheet S, which has been transported along the reverse path SH4, to pass therethrough once. When the recording sheet S that has passed through the third gate GT3 is switched back, the third gate GT3 guides the recording sheet S to the side on which the circulation path SH6 is disposed.

The recording sheet S that has been transported to the circulation path SH6 is sent to the second transfer region Q4 again through the media transport path SH2, and a printing operation is performed on a second surface of the recording sheet S, the second surface being opposite to the image fixed surface of the recording sheet S.

The above-described components that are denoted by the reference signs SH1 to SH7 form a sheet transport path SH. The above-described components that are denoted by the reference signs SH, Ra, Rr, Rh, SGr, SG1, SG2, BH, and GT1 to GT3 form a sheet transport device SU according to the first exemplary embodiment.

(Description of Controller of First Exemplary Embodiment)

Figure 3:
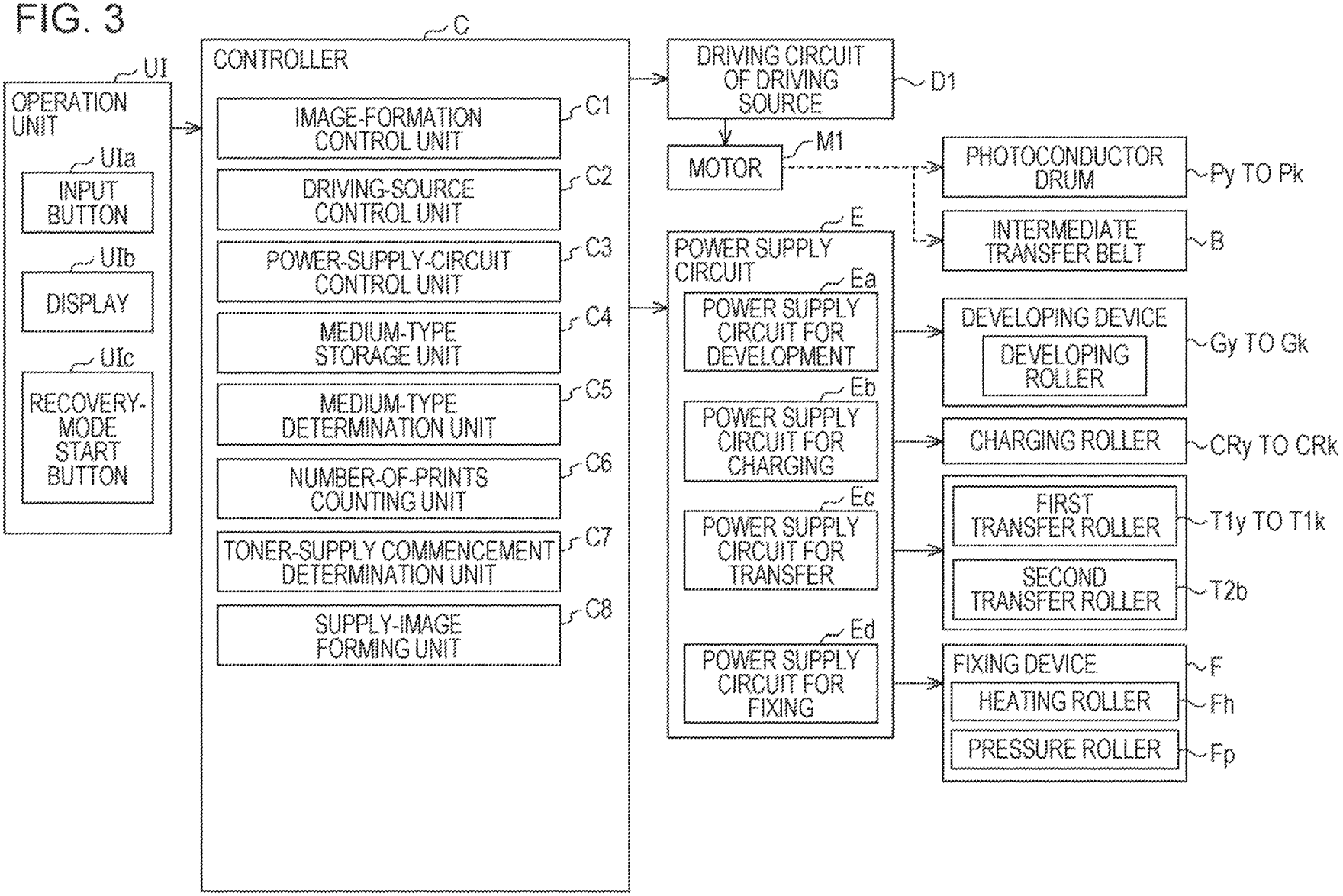
FIG. 3 is a block diagram illustrating functions of a controller of the image forming apparatus according to the first exemplary embodiment.

FIG. 3 is a block diagram illustrating functions of a controller of the image forming apparatus according to the first exemplary embodiment.

In FIG. 3, a controller C, which is an example of a control unit of the copying machine U, includes an input/output interface I/O that inputs and outputs signals to and from the outside. The controller C further includes read only memory (ROM) that stores programs and information for processing to be performed, information, and so forth. The controller C further includes random access memory (RAM) that temporarily stores necessary data. The controller C further includes a central processing unit (CPU) that performs processing according to the programs stored in the ROM and the like. Accordingly, the controller C of the first exemplary embodiment is formed of a small-sized information processing apparatus, or specifically, a microcomputer. Thus, the controller C may obtain various functions by executing the programs stored in the ROM and the like.

(Signal-Output Element Connected to Controller C)

An output signal from a signal-output element, such as the user interface UI, is input to the controller C.

The user interface UI includes, as examples of input units, the input buttons UIa including a copy start key, a numeric keypad, and an arrow that are used for performing input operations, the display UIb, and a recovery-mode start button UIc that is used for performing an input operation for starting a recovery mode.

The recovery-mode start button UIc enables a user to input an instruction to perform an operation in a recovery mode for forming a toner-supply image, which is an image that is not intended to be transferred onto one of the recording sheets S, onto the intermediate transfer belt B, which is an example of an image holding unit.

Note that the various input buttons UIa and the recovery-mode start button UIc are not limited to being provided as hardware buttons and may be provided in the form of buttons that are displayed as images on the display UIb which is, for example, a touch panel through which an input operation may be performed.

(To-be-Controlled Element Connected to Controller C)

The controller C is connected to a driving circuit D1 of a driving source, a power-supply circuit E, and other control elements (not illustrated). The controller C outputs control signals to the circuits D1, E, and the like so as to control the circuits D1, E, and the like.

D1: Driving Circuit of Driving Source

The photoconductor drums Py to Pk, the intermediate transfer belt B, and so forth are driven so as to rotate by the driving circuit D1 of the driving source via a motor M1, which is an example of a driving source.

E: Power-Supply Circuit

The power-supply circuit E includes a power-supply circuit Ea for use in a developing operation, a power-supply circuit Eb for use in a charging operation, a power-supply circuit Ec for use in a transfer operation, and a power-supply circuit Ed for use in a fixing operation.

Ea: Power-Supply Circuit for Development

The power-supply circuit Ea for use in a developing operation applies a developing voltage to the developing rollers of the developing devices Gy to Gk.

Eb: Power-Supply Circuit for Charging

The power-supply circuit Eb for use in a charging operation applies a charging voltage for charging the surfaces of the photoconductor drums Py to Pk to the charging rollers CRy to CRk.

Ec: Power-Supply Circuit for Transfer

The power-supply circuit Ec for use in a transfer operation applies a transfer voltage to the first transfer rollers T1*y* to T1*k* and the backup roller T2*a*.

Ed: Power-Supply Circuit for Fixing

The power-supply circuit Ed for use in a fixing operation supplies power to a heater of the heating roller Fh of the fixing device F.

(Functions of Controller C)

The controller C has a function of outputting a control signal to each of the above-mentioned control elements by performing processing according to an input signal from the above-mentioned signal-output element. In other words, the controller C has the following functions.

C1: Image-Formation Control Unit

An image-formation control unit C1 controls, for example, driving of the members included in the scanner unit U1 and the image forming unit U3 or the timing of application of each voltage in accordance with an input to the user interface UI or an input of image information from an external personal computer or the like and executes a job, which is an image forming operation.

C2: Driving-Source Control Unit

A driving-source control unit C2 controls driving of the motor M1 via the driving circuit D1 of the driving source and controls driving of the photoconductor drums Py to Pk and so forth.

C3: Power-Supply-Circuit Control Unit

A power-supply-circuit control unit C3 controls the power-supply circuits Ea to Ed and controls the voltages to be applied to each member and the power to be supplied to member.

C4: Medium-Type Storage Unit

A medium-type storage unit C4 stores the types of the recording sheets S, each of which is an example of a medium to be used. The types of the recording sheets S, which are accommodated in the sheet-feeding trays TR1 to TR4 of the feeder unit U2, are stored in the sheet-type-information storage unit C4 according to the first exemplary embodiment in such a manner as to be distinguished in accordance with the sheet-feeding trays TR1 to TR4. Note that, in the first exemplary embodiment, the types of the recording sheets S, which are accommodated in the sheet-feeding trays TR1 to TR4, that are set and registered by input operations performed through the user interface UI are stored. The types of the recording sheets S may each be set to one selected from "thin paper", "normal paper", "thick paper", "embossed paper", "Japanese paper", "coated paper", and so forth, or the type of each of the recording sheets S may be set by, for example, directly inputting a "sheet basis weight".

C5: Medium-Type Determination Unit

A medium-type determination unit C5 determines the type of one of the recording sheets S that is used in a printing operation. The sheet-type-information determination unit C5 according to the first exemplary embodiment determines the type of the recording sheet S on the basis of information items regarding the types of the recording sheets S in the sheet-feeding trays TR1 to TR4, the information items being stored in the medium-type storage unit C4, and at least one of the sheet-feeding trays TR1 to TR4 that is used in the printing operation. In addition, the sheet-type-information determination unit C5 according to the first exemplary embodiment determines whether the recording sheet S is one of embossed paper and Japanese paper, each of which is an example of a medium having a high transfer sensitivity, or one of thin paper, normal paper, thick paper, and coated paper, each of which is an example of a medium having a low transfer sensitivity.

Note that, in the specification and the claims of the present application, the term "transfer sensitivity" refers to the non-transferability of an image to one of the recording sheets S and, on the other hand, refers to the transferability of an image to one of the recording sheets S. In the following description, a medium in which a transfer failure is likely to occur when there are fluctuations in the environments such as temperature and humidity when there are fluctuations in an applied voltage, or even when the speed at which a medium is transported is slightly changed will be referred to as "a medium having a high transfer sensitivity". Conversely, a medium in which a transfer failure is less likely to occur will be referred to as "a medium having a low transfer sensitivity". Therefore, thin paper, normal paper, thick paper, and coated paper each of which has a smooth surface and a substantially uniform density of fiber such as pulp have a low transfer sensitivity. In contrast, embossed paper that has projections and depressions formed on its surface and Japanese paper (a medium having a low density) that has an uneven density of pulp or the like and a large number of voids formed therein have a high transfer sensitivity. Although it will be described later with reference to FIG. 6, this is because, when a transfer voltage is applied to embossed paper or Japanese paper, the electrical resistance of a portion of the paper, the portion having a recess or a void, (a portion containing no fiber) and the electrical resistance of a portion of the paper, the portion containing fiber, are different from each other, or when electric discharge occurs in a recess or a void, the transfer voltage fluctuates, and a transfer failure is likely to occur.

Note that, in the following description, sheets such as embossed paper and Japanese paper will sometimes be inclusively referred to as "high sensitive sheets" each of which is an example of a first medium, and sheets such as normal paper will sometimes be inclusively referred to as "low sensitive sheets" each of which is an example of a second medium.

Note that, in the first exemplary embodiment, although the case has been described as an example in which the type of a medium is determined on the basis of the information items stored in the medium-type storage unit C4, the present disclosure is not limited to this case. For example, a sensor may be disposed in each of the sheet-feeding trays TR1 to TR4 of the feeder unit U2 or may be disposed on at least one of the transport paths SH1 and SH2 extending from the sheet-feeding trays TR1 to TR4 to the registration rollers Rr, the sensor being an example of a sensing member that detects the type of a medium on the basis of the thickness, the light transmittance, the light reflectance, the polarization property, the surface roughness, and so forth of the medium, and the type of one of the recording sheets S that is used in a printing operation may be detected and determined. Thus, for example, when the surface roughness of one of the recording sheets S that is detected by such a sensor is greater than a predetermined value (a threshold), that is, when projections and depressions formed on the surface of the recording sheet S are large, the recording sheet S may be determined to be a high sensitive sheet. In addition, the density (=weight/(thicknessxarea)) of the recording sheet S that is detected by the sensor is less than a predetermined value (a threshold), that is, when the recording sheet S has a large number of voids formed therein, the recording sheet S may be determined to be a high sensitive sheet.

C6: Number-of-Prints Counting Unit

A number-of-prints counting unit C6, which is an example of a number-of-transfers counting unit, counts the number of prints, which is an example of the number of transfers. In other words, the number-of-prints counting unit C6 counts the number of times a transfer operation for transferring a print image, which is an example of an image that is intended to be transferred, onto one of the recording sheets S has been performed. Note that, in the first exemplary embodiment, when a toner-supply image (described later), which is an example of an image that is not intended to be transferred, is formed, the number of prints is initialized, or reset.

C7: Toner-Supply Commencement Determination Unit

A toner-supply commencement determination unit C7 determines whether the timing at which a toner-supply image is to be formed has come. The toner-supply commencement determination unit C7 in the first exemplary embodiment determines that the timing at which a toner-supply image is to be formed has come when a predetermined condition for supplying a toner, which is an example of a developer, to the surface of the intermediate transfer belt B is satisfied. As an example, in the case where a high sensitive sheet such as embossed paper is used, the toner-supply commencement determination unit C7 determines that the timing at which a toner-supply image is to be formed has come before a job (a series of printing operations) is started. In other words, when the copying machine U receives a print instruction to form a print image (an image that is intended to be transferred) onto a high sensitive sheet, it is determined that the timing at which a toner-supply image is to be formed has come. In addition, along with execution of a job, when the number of prints counted by the number-of-prints counting unit C6 reaches a predetermined number of prints since the previous toner supply, it is determined that the timing at which a toner-supply image is to be formed has come. The predetermined number of prints may be, for example, 10. However, the predetermined number of prints may be arbitrarily changed to, for example, 1 or 100, in accordance with design, specification, the sensitivity of a sheet to be used, or the like. The toner-supply commencement determination unit C7 according to the first exemplary embodiment also determines that the timing at which a toner-supply image is to be formed has come when an input operation using the recovery-mode start button UIc is performed. Therefore, in the first exemplary embodiment, three timings are set as an example of the condition for supplying a toner to the surface of the intermediate transfer belt B, the three timings including before a job using a high sensitive sheet is started, when the number of prints reaches the predetermined number of prints during execution of a job using a high sensitive sheet, and when an input operation using the recovery-mode start button UIc is performed.

Figure 4A:
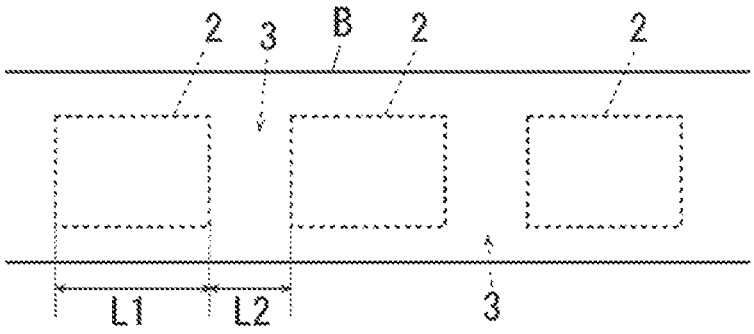
FIGS. 4A to 4C are diagrams illustrating examples of toner-supply images according to the first exemplary embodiment, FIG. 4A, FIG. 4B, and FIG. 4C being respectively a diagram illustrating an image forming region and a non-forming region, a diagram illustrating toner-supply images that are formed when the number of times an intermediate transfer belt moves circularly is an odd number, and a diagram illustrating toner-supply images that are formed when the number of times the intermediate transfer belt moves circularly is an even number.
Figure 4B:
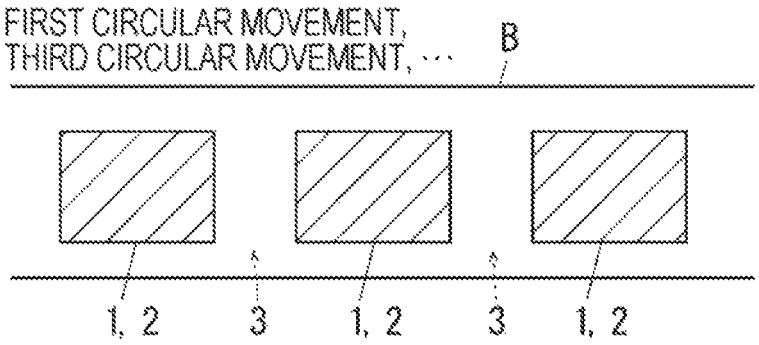
Figure 4C:
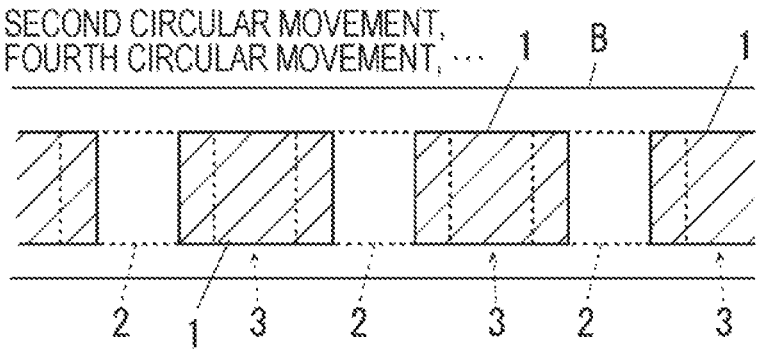

FIGS. 4A to 4C are diagrams illustrating examples of toner-supply images according to the first exemplary embodiment. FIG. 4A is a diagram illustrating an image forming region and a non-forming region. FIG. 4B is a diagram illustrating toner-supply images that are formed when the number of times an intermediate transfer belt moves circularly is an odd number. FIG. 4C is a diagram illustrating toner-supply images that are formed when the number of times the intermediate transfer belt moves circularly is an even number.

C8: Supply-Image Forming Unit (Example of Forming Unit)

A supply-image forming unit C8 forms toner-supply images 1 each of which is an example of an image that is not intended to be transferred. The supply-image forming unit C8 forms the toner-supply images 1 when the toner-supply commencement determination unit C7 determines that the timing at which the toner-supply images 1 are to be formed has come. The toner-supply images 1 are transferred onto the intermediate transfer belt B and then removed by the belt cleaner CLB without being transferred onto the recording sheets S.

In FIGS. 4A to 4C, image regions 2, each of which is an example of an image forming region, are formed on the intermediate transfer belt B, and inter-image regions 3, each of which is an example of a non-forming region, are each formed between two of the image regions 2. The size of each of the toner-supply images 1 according to the first exemplary embodiment is the same as the size of each of the image regions 2 as illustrated in FIG. 4B. In other words, each of the toner-supply images 1 according to the first exemplary embodiment has a length the same as a length L1 of each of the image regions 2, the length L1 being an example of a predetermined length, in the direction in which the intermediate transfer belt B moves circularly. The toner-supply images 1 are formed at a pitch that is the same as a length L2 of each of the inter-image regions 3.

In the first exemplary embodiment, as an example, the toner-supply images 1 are to be formed during the period when the intermediate transfer belt B moves circularly five times. Note that the number of times the intermediate transfer belt B moves circularly during the period when the toner-supply images 1 are formed is not limited to five times and may be changed in accordance with design, specification, or the like. In the first exemplary embodiment, as illustrated in FIG. 4B and FIG. 4C, when the number of times the intermediate transfer belt B moves circularly is an odd number, the toner-supply images 1 are formed at positions that correspond to the image regions 2, and when the number of times the intermediate transfer belt B moves circularly is an even number, the toner-supply images 1 are formed at positions that correspond to the spaces between the toner-supply images 1 formed when the number of times the intermediate transfer belt B moves circularly is an odd number, that is, the toner-supply images 1 are formed on regions that cover (overlap) the inter-image regions 3. Note that the present disclosure is not limited to the configuration described above as an example in which the toner-supply images 1 that cover the image regions 2 are formed when the number of times the intermediate transfer belt B moves circularly is an odd number and in which the toner-supply images 1 that cover the inter-image regions 3 are formed when the number of times the intermediate transfer belt B moves circularly is an even number. For example, instead of two circular movements, three circular movements may be set as one set in such a manner that the positions where the toner-supply images 1 are formed at the second circular movement are each displaced from one of the positions where the toner-supply images 1 are formed at the first circular movement by a distance (L1+L2)/3, and the positions where the toner-supply images 1 are formed at the third circular movement are each displaced from one of the positions where the toner-supply images 1 are formed at the second circular movement by a distance (L1+L2)/3. Similarly, it may be changed to, for example, a set of four circular movements or a set of five circular movements.

As an example, an image having a total density of 200% that is formed by superposing halftones of colors Y, M, C, and K each having a density of 50% with one another is used for each of the toner-supply images 1 according to the first exemplary embodiment. Note that the density of each of the toner-supply images 1 is not limited to the density mentioned above as an example and may be any density value. The number of toner colors to be used is not limited to four and may be three or smaller. In addition, a color toner to be used may be a color toner that has deteriorated among the four color toners, that is, a color toner with which the ratio of an image having a predetermined low density to the accumulated number of prints is higher than a predetermined ratio.

(Description of Flowchart of First Exemplary Embodiment)

A control flow in the copying machine U according to the first exemplary embodiment will now be described with reference to a flowchart.

(Description of Flowchart of Toner-Supply-Image Forming Process)

Figure 5:
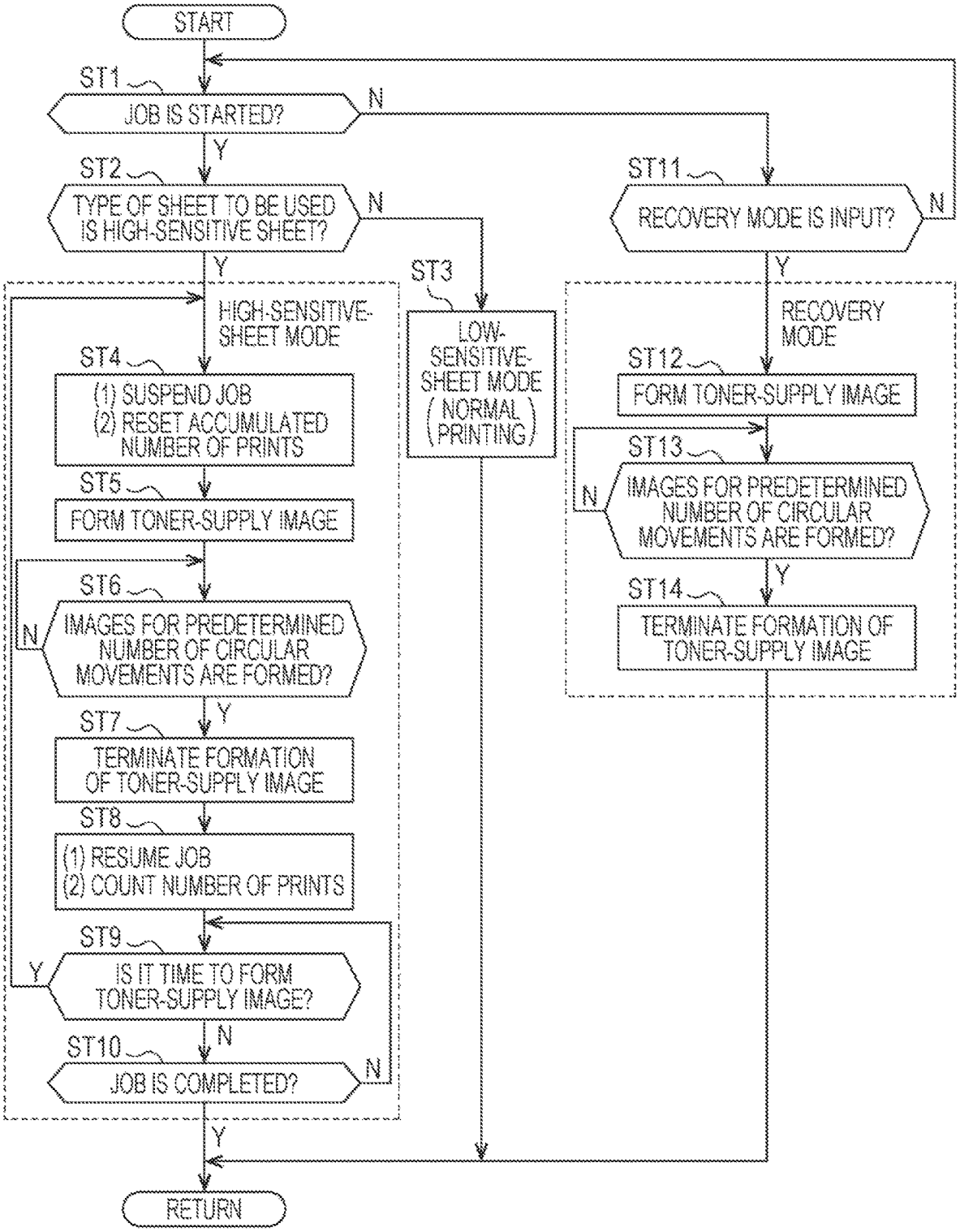
FIG. 5 is a flowchart of a toner-supply-image forming process according to the first exemplary embodiment.

FIG. 5 is a flowchart of a toner-supply-image forming process according to the first exemplary embodiment.

The operations in steps ST of the flowchart illustrated in FIG. 5 are each performed in accordance with a program stored in the controller C of the copying machine U. The process is executed in parallel with various other processes performed by the copying machine U. Thus, a process in which an image is formed on each of the recording sheets S upon start of a job is executed in parallel with the process illustrated in the flowchart in FIG. 5.

The process illustrated in the flowchart in FIG. 5 is started when the copying machine U is switched on.

In ST1 in FIG. 5, it is determined whether a job has been started. When the determination result in ST1 is Yes (Y), the process continues to ST2, and when the determination result in ST1 is No (N), the process proceeds to ST11.

In ST2, it is determined whether one of the recording sheets S that is used in the started job is a high sensitive sheet. When the determination result in ST2 is No (N), the process continues to ST3, and when the determination result in ST2 is Yes (Y), the process proceeds to ST4.

In ST3, an operation in a low-sensitive-sheet mode, which is an example of a second forming mode, that is, a normal image forming operation, is performed, and the process returns to ST1.

In ST4, the following processing operations (1) and (2) are performed, and the process continues to ST5.

(1) The job is suspended, that is, no job is started.

(2) The accumulated number of prints is reset, or initialized.

In ST5, formation of the toner-supply images 1 is started. Then, the process continues to ST6.

In ST6, it is determined whether the toner-supply images 1 for a predetermined number of circular movements (five circular movements in the first exemplary embodiment) have been formed. When the determination result in ST6 is Yes (Y), the process continues to ST7, and when the determination result in ST6 is No (N), ST6 is repeated.

In ST7, the formation of the toner-supply images 1 is terminated. Then, the process continues to ST8.

In ST8, the following processing operations (1) and (2) are performed, and the process continues to ST9.

(1) A job is started or resumed.

(2) Counting of the accumulated number of prints is started.

In ST9, it is determined whether the timing at which the toner-supply images 1 are to be formed has come. When the determination result in ST9 is Yes (Y), the process returns to ST4, and when the determination result in ST9 is No (N), the process continues to ST10.

In ST10, it is determined whether the job has been terminated. When the determination result in ST10 is Yes (Y), the process returns to ST1, and when the determination result in ST10 is No (N), the process returns to ST9.

In ST11, it is determined whether an input operation using the recovery-mode start button UIc has been performed. When the determination result in ST11 is Yes (Y), the process continues to ST12, and when the determination result in ST11 is No (N), the process returns to ST1.

In ST12, formation of the toner-supply images 1 is started. Then, the process continues to ST13.

In ST13, it is determined whether the toner-supply images 1 for a predetermined number of circular movements (five circular movements in the first exemplary embodiment) have been formed. When the determination result in ST13 is Yes (Y), the process continues to step ST14, and when the determination result in ST13 is No (N), ST13 is repeated.

In ST14, the formation of the toner-supply images 1 is terminated. Then, the process returns to ST1.

Effects of First Exemplary Embodiment

In the copying machine U according to the first exemplary embodiment, which has the above-described configuration, an image is formed in the low-sensitive-sheet mode when a low sensitive sheet is used, and an image is formed in a high-sensitive-sheet mode including ST4 to ST10, which is an example of a first forming mode, when a high sensitive sheet is used.

Figure 6A:
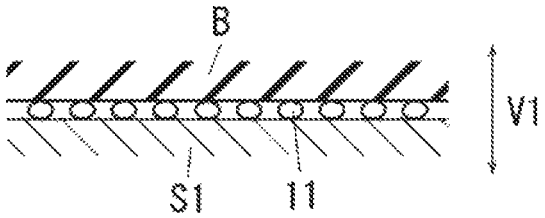
FIGS. 6A to 6C are diagrams each illustrating a voltage that acts in a transfer region, FIG. 6A, FIG. 6B, and FIG. 6C being respectively a diagram illustrating an example of a low sensitive sheet, a diagram illustrating an example of embossed paper, and a diagram illustrating an example of Japanese paper.
Figure 6B:
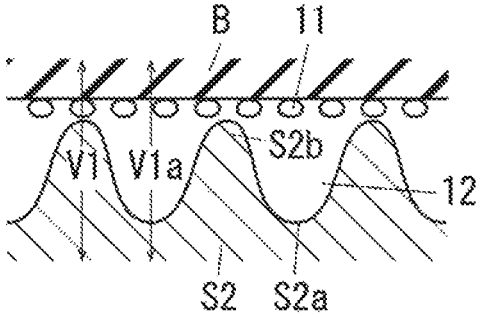
Figure 6C:
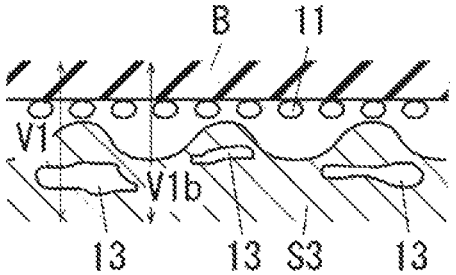

FIGS. 6A to 6C are diagrams each illustrating a voltage that acts in a transfer region. FIG. 6A is a diagram illustrating an example of a low sensitive sheet. FIG. 6B is a diagram illustrating an example of embossed paper. FIG. 6C is a diagram illustrating an example of Japanese paper.

In FIGS. 6A to 6C, a low sensitive sheet (a second medium) S1 such as normal paper has a smooth surface and has only few voids formed therein, and thus, the second transfer voltage approximately acts uniformly in the second transfer region Q4.

In contrast, as illustrated in FIG. 6B, embossed paper S2, which is an example of a high sensitive sheet (a first medium), has projections and depressions formed on its surface, and gaps 12 is formed between depressions S2*a* and the intermediate transfer belt B. Thus, the electrical resistance varies between projections S2*b* having no gap 12 and the depressions S2*a* having the gaps 12 in a thickness direction. Consequently, electric discharge is likely to occur in the gaps 12, and there is a possibility that a second transfer voltage Via that acts in the depressions S2*a* will change. Therefore, in the depressions S2*a*, a transfer failure is more likely to occur than in the low sensitive sheet S1.

In FIG. 6C, in Japanese paper S3, which is an example of a high sensitive sheet, voids (gaps) 13 are easily formed therein, and as in the case of the embossed paper S2, a transfer failure is more likely to occur in a portion that has the voids 13 than in a portion that does not have the voids 13. In other words, not only in Japanese paper, but also in one of the recording sheets S that has voids formed therein and that has a low-density, a transfer failure is likely to occur.

Thus, in the case of using a high sensitive sheet, there is a problem in that a toner is less likely to be transferred onto the high sensitive sheet. Transfer is a phenomenon in which a toner held on the intermediate transfer belt B by, for example, an electrostatic force or an adhesive force moves to one of the recording sheets S, and if the adhesive force of the toner with respect to the intermediate transfer belt B is weakened, the toner becomes likely to be transferred.

It has been found from the research conducted by the inventors of the present disclosure that transferability is improved as a result of providing a developer, by using the toner-supply images 1, beforehand to regions of the intermediate transfer belt B in which images are to be formed. Although the detailed principle is unknown, it is assumed that silicone oil, which is as an example of a release component contained in the developer is supplied to the intermediate transfer belt B. It is assumed that, when an image (a print image) to be transferred onto one of the recording sheets S is formed on the surface of the silicone oil deposited on the intermediate transfer belt B, the adhesive strength between the developer forming the print image and the intermediate transfer belt B is weakened by the silicone oil, and the transferability is improved even in the case of using a high sensitive sheet.

Thus, in the first exemplary embodiment, when a print instruction to use a high sensitive sheet as one of the recording sheets S is received, the toner-supply images 1 are formed before an image that is to be transferred onto the recording sheet S (an image that is intended be transferred onto a medium) is formed. Consequently, the adhesive strength between the print image that is transferred onto the recording sheet S and the intermediate transfer belt B is weakened. Therefore, the occurrence of a transfer failure is suppressed compared with the configuration of the related art in which the toner supply images 1 are not formed beforehand.

EXPERIMENTAL EXAMPLE

Next, an experiment for confirming the effects of the present disclosure is performed.

First Experimental Example

In a first experimental example, the adhesive force of a developer in an image portion of the intermediate transfer belt B where an image has been formed and the adhesive force of a developer in a non-image portion of the intermediate transfer belt B where no image has been formed are measured. In the experiment, these adhesive forces are measured in a state where the toner-supply images 1 are not formed (before the recovery mode), and the adhesive forces are measured after the toner-supply images 1 have been formed in both a region corresponding to the image portion and a region corresponding to the non-image portion (after the recovery mode in ST12 and ST13).

In this adhesive-force measurement, the intermediate transfer belt B is stopped in a state where the developer is deposited on the intermediate transfer belt B, and air is blown onto the developer. The air pressure (wind pressure) at which the developer that is blown off by the air is visually observed is set as an adhesive force index (Pa).

Figure 7:
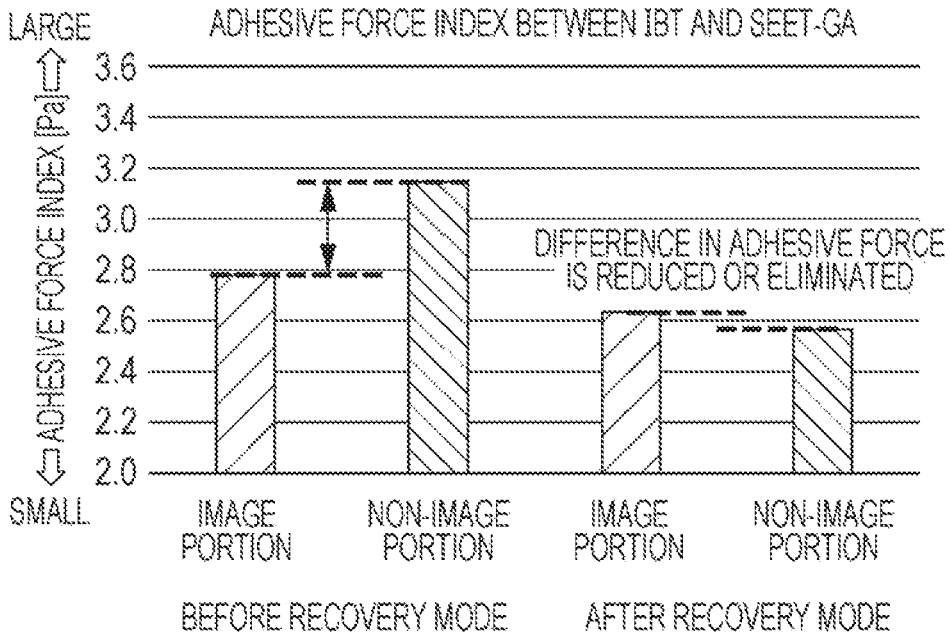
FIG. 7 is a graph illustrating experimental results of the adhesive force of a developer on the intermediate transfer belt, the vertical axis of the graph denoting the adhesive force.

The experimental results are illustrated in FIG. 7.

FIG. 7 is a graph illustrating experimental results of the adhesive force of a developer on the intermediate transfer belt, the vertical axis of the graph denoting the adhesive force.

In FIG. 7, the adhesive force in the non-image portion is large before an operation in the recovery mode is performed, and the adhesive force is reduced after the operation in the recovery mode in which the toner-supply images 1 are provided has been performed. Note that, also in the image portion, the adhesive force after the operation in the recovery mode has been performed is lower than that before the operation in the recovery mode is performed. In addition, after the operation in the recovery mode has been performed, the difference in the adhesive force between the image portion and the non-image portion is reduced or eliminated.

Figure 8:
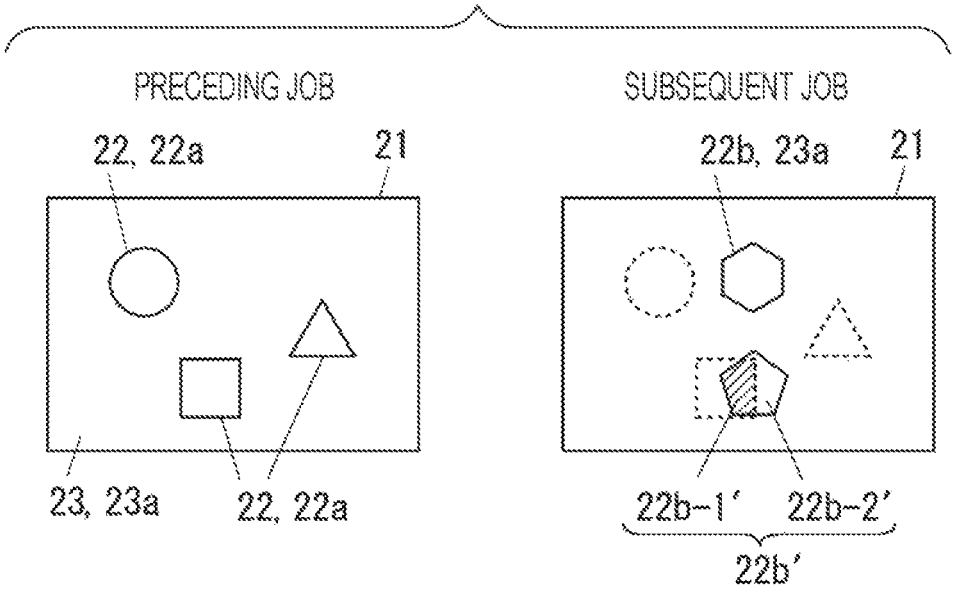
FIG. 8 is a diagram illustrating a relationship between an example of an image that is intended to be transferred onto a medium and a toner-supply image.

FIG. 8 is a diagram illustrating a relationship between an example of an image that is intended to be transferred onto a medium and a toner-supply image.

In FIG. 8, a region 21 of an image that corresponds to a single page has regions 22 of characters, figures, photographic images, and the like, onto which a developer is transferred and a region 23 onto which the developer is not transferred. In a region 23*a* onto which the developer is not transferred in a preceding job, the adhesive force of the developer on the intermediate transfer belt B is large like in the non-image portion before the operation in the recovery mode, which is illustrated in FIG. 7, is performed. Thus, as illustrated in FIG. 8, in the case where the region 23*a* onto which the developer is not transferred in the preceding job becomes a region 22*b* onto which the developer is transferred in a subsequent job, the adhesive force of the developer increases, and there is a possibility that a transfer failure will occur. In addition, in the case where a region 22*b*' onto which the developer is transferred in the subsequent job has a region 22*b*-1' that overlaps the region 22*a* onto which the developer is transferred in the preceding job and a region 22*b*-2' that overlaps the region 23*a* onto which the developer is not transferred in the preceding job, if the operation in the recovery mode is not performed, there is a possibility that a partial transfer failure will occur due to a difference in adhesive force and that an image quality defect will become noticeable.

In contrast, in the present application, when a high sensitive sheet is used in a subsequent job, the toner-supply images 1 are formed before the subsequent job is executed. Thus, as in the state after the operation in the recovery mode has been performed, which is illustrated in FIG. 7, the adhesive force of the developer is reduced, and the subsequent job is executed in a state where the difference in the adhesive force has been reduced or eliminated. Therefore, the occurrence of a transfer failure in the subsequent job using a high sensitive sheet is suppressed.

In the first exemplary embodiment, the toner-supply images 1 are formed not only in the case where a high sensitive sheet is used, but also each time a printing operation has been performed on a predetermined number of sheets. Formation of the toner-supply images 1 may be performed through an input operation using the recovery-mode start button UIc. Thus, when a user desires to start the recovery mode after checking the quality of a printed image, the recovery mode may be manually started.

In the first exemplary embodiment, the toner-supply images 1 are formed during the period when the intermediate transfer belt B moves circularly a plurality of times. In the case where the toner-supply images 1 are formed during the period when the intermediate transfer belt B moves circularly only once, there is a possibility that the amount of a release component of a developer that is supplied will be insufficient. However, in the case where the toner-supply images 1 are provided during the period when the intermediate transfer belt B moves circularly a plurality of times, a sufficient amount of the release component may be supplied.

(Modifications)

Figure 9A:
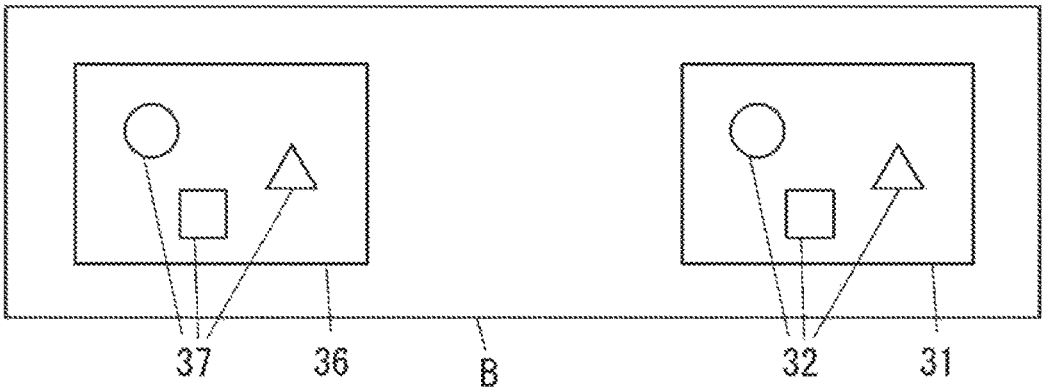
FIGS. 9A to 9C are diagrams illustrating modifications of toner-supply images, FIG. 9A, FIG. 9B, and FIG. 9C being respectively a diagram illustrating a case where a toner-supply image corresponds to all the images that are intended to be transferred, a diagram illustrating a case where a toner-supply image is also formed at a position different from the images that are intended to be transferred, and a diagram illustrating a case where a toner-supply image corresponds to a portion of the images that are intended to be transferred.
Figure 9B:
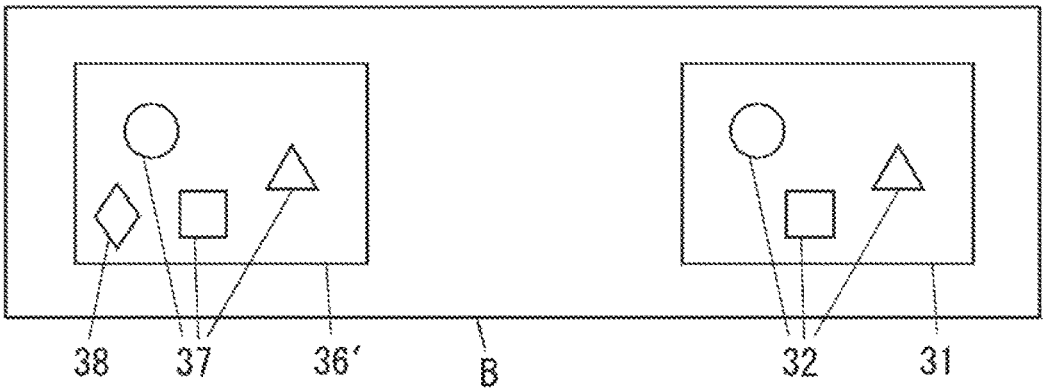
Figure 9C:
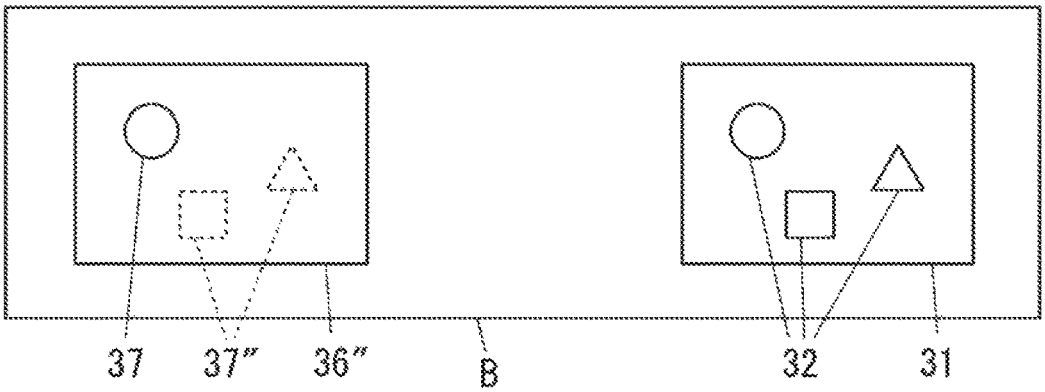

FIGS. 9A to 9C are diagrams illustrating modifications of toner-supply images. FIG. 9A is a diagram illustrating a case where a toner-supply image corresponds to all the images that are intended to be transferred. FIG. 9B is a diagram illustrating a case where a toner-supply image is also formed at a position different from the images that are intended to be transferred. FIG. 9C is a diagram illustrating a case where a toner-supply image corresponds to a portion of the images that are intended to be transferred.

In the above-described first exemplary embodiment, although the case has been described in which each of the toner-supply images 1 is an image that covers the entire corresponding image region 2, that is, an image that covers the entire image that is intended to be transferred, the present disclosure is not limited to this configuration.

As illustrated in FIG. 9A, a toner-supply image 36 that supplies a developer to portions 37 that correspond to all the image portions 32 included in an image 31 that is formed in a subsequent job may be formed.

As illustrated in FIG. 9B, a toner-supply image 36' that supplies the developer to the portions 37, which correspond to all the image portions 32 in the image 31 formed in the subsequent job, and also to a portion 38 that is different from the image portions 32 may be formed. For example, the toner-supply image 36' may be formed in such a manner that, when no image has been formed on the portion 38 in past jobs for a long period of time, and the adhesive force of the developer has become so large that the adhesive force may not be sufficiently reduced by forming the toner-supply images 1 once, the toner-supply image 36' supplies the developer to the portion 38 even though the portion 38 is different from the image portions 32.

As illustrated in FIG. 9C, a toner-supply image 36" that supplies the developer to only a portion of the portions 37, which corresponds to the image portions 32 in the image 31 formed in the subsequent job, may be formed. In other words, the toner-supply image 36" that has portions 37" each of which corresponds to one of the image portions 32 and each of which is not supplied with the developer may be formed. For example, in the case where images have been continuously formed in the portions 37" in past jobs, so that the adhesive force of the developer has been sufficiently reduced, supplying the developer to the portions 37" is likely to be wasteful. Thus, the toner-supply image 36" that does not supply the developer to the portions 37" in this case may be formed.

(Modifications)

Although the exemplary embodiment of the present disclosure has been described in detail above, the present disclosure is not limited to the above-described exemplary embodiment, and various changes may be made within the scope of the present disclosure as described in the claims. Modifications (H01 to H05) of the present disclosure will be described below as examples.

(H01) In the above-described exemplary embodiment, although the copying machine U has been described as an example of an image forming apparatus, the image forming apparatus is not limited to the copying machine U, and the present disclosure may be applied to, for example, a facsimile machine or a multifunction machine that has a plurality of functions of a facsimile machine, a printer, a copying machine, and so forth. In addition, the image forming apparatus is not limited to being an image forming apparatus for multicolor development and may be an image forming apparatus that forms monochromatic images, or specifically, black-and-white images.

(H02) The specific values that have been mentioned as examples in the above-described exemplary embodiment may be suitably changed in accordance with design or specification.

(H03) In the above-described exemplary embodiment, although a case has been described as an example in which the toner-supply images 1 are formed when a high sensitive sheet is used, the present disclosure is not limited to this case. The toner-supply images 1 may be formed also when a low sensitive sheet is used. In addition, in the case where the adhesive force of a developer increases, that is, for example, when the humidity is high, when the percentage of a deteriorated developer becomes high, or when an image holding unit such as the intermediate transfer belt B deteriorates over time, the toner-supply images 1 may be formed in accordance with an image that is formed in a subsequent job.

(H04) In the above-described exemplary embodiment, although it is desirable that the recovery mode, in which the toner-supply images 1 are formed, be started through an input operation using the recovery-mode start button UIc, a configuration in which the recovery-mode start button UIc is not provided and in which the operation in the recovery mode is not performed may be employed.

(H05) In the above-described exemplary embodiment, although each toner-supply image has one of the configurations illustrated as examples in FIGS. 4A to 4C and FIGS. 9A to 9C, the configurations of the toner-supply images are not limited to the configurations. For example, in the case where an image portion is a character, suitable modifications may be made such that, for example, a toner-supply image is formed so as to have a quadrangular shape surrounding the character or so as to be slightly larger than the image portion. Alternatively, the toner-supply image may be formed so as to have a specific shape such as a circular shape or a polygonal shape that includes the image portion. In addition, the color, the density, and so forth may also be suitably changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding unit that holds an image that is formed of a developer, the image being intended to be transferred onto a medium, and an image that is not intended to be transferred onto a medium;

a transfer unit that transfers the image that is intended to be transferred onto a medium onto a medium; and a forming unit that forms, upon receiving a print instruction to form the image that is intended to be transferred onto a medium onto the image holding unit, the image that is not intended to be transferred onto a medium at a position on the image holding unit where the image that is intended to be transferred onto a medium is to be formed.

2. The image forming apparatus according to claim 1, wherein the image that is not intended to be transferred onto a medium is a halftone image.

3. The image forming apparatus according to claim 1, wherein the forming unit has a first forming mode for a first medium and a second forming mode for a second medium that has a transfer sensitivity lower than a transfer sensitivity of the first medium, and wherein, in the first forming mode, before the image that is intended to be transferred onto a medium is formed onto the image holding unit, the forming unit forms the image that is not intended to be transferred onto a medium at a position on the image holding unit where the image that is intended to be transferred onto a medium is to be formed.

4. The image forming apparatus according to claim 3, wherein the first medium includes embossed paper or Japanese paper.

5. The image forming apparatus according to claim 4, wherein the second medium includes thin paper, normal paper, thick paper, or coated paper.

6. The image forming apparatus according to claim 1, further comprising:

an input unit that enables a user to perform an input operation and that enables a user to input an instruction to perform an operation for forming the image that is not intended to be transferred onto a medium onto the image holding unit.

7. The image forming apparatus according to claim 1, wherein the forming unit forms the image that is not intended to be transferred onto a medium during a period when the image holding unit moves circularly a plurality of times.

8. The image forming apparatus according to claim 7, wherein the image that is not intended to be transferred onto a medium has a predetermined length in a direction in which the image holding unit moves circularly.

9. The image forming apparatus according to claim 8, wherein the forming unit forms the image that is not intended to be transferred onto a medium between a plurality of the images each of which is not intended to be transferred onto a medium with a gap formed between each two of the images and forms, in at least one of next and subsequent circular movements of the image holding unit, the image that is not intended to be transferred onto a medium in regions each of which overlaps one of the gaps.

10. The image forming apparatus according to claim 9, wherein the image that is not intended to be transferred onto a medium is formed a region that overlaps all the gaps.

11. The image forming apparatus according to claim 1, wherein the image that is not intended to be transferred onto a medium is formed by the forming unit so as to correspond to a portion of the image that is intended to be transferred onto a medium.

12. The image forming apparatus according to claim 1, wherein the image that is not intended to be transferred onto a medium is formed by the forming unit so as to correspond to the entire image that is intended to be transferred onto a medium.

13. The image forming apparatus according to claim 11, wherein the forming unit forms the image that is not intended to be transferred onto a medium also at a position different from the image that is intended to be transferred onto a medium.

14. The image forming apparatus according to claim 1, wherein the image that is not intended to be transferred onto a medium is formed by the forming unit so as to cover an entire region in which the image that is intended to be transferred onto a medium is formable.

15. An image forming apparatus comprising:

an image holding unit that holds an image that is formed of a developer, the image being intended to be transferred onto a medium, and an image that is not intended to be transferred onto a medium;

a transfer unit that transfers the image that is intended to be transferred onto a medium onto a medium; and a forming unit that forms, when a predetermined condition for supplying a developer to a surface of the image holding unit is satisfied, the image that is not intended to be transferred onto a medium and causes the surface of the image holding unit to hold the image.

16. The image forming apparatus according to claim 15, wherein the forming unit forms the image that is not intended to be transferred onto a medium during a period when the image holding unit moves circularly a plurality of times.

17. The image forming apparatus according to claim 16, wherein the image that is not intended to be transferred onto a medium has a predetermined length in a direction in which the image holding unit moves circularly.

18. The image forming apparatus according to claim 17, wherein the forming unit forms the image that is not intended to be transferred onto a medium between a plurality of the images each of which is not intended to be transferred onto a medium with a gap formed between each two of the images and forms, in at least one of next and subsequent circular movements of the image holding unit, the image that is not intended to be transferred onto a medium in regions each of which overlaps one of the gaps.

19. An image forming apparatus comprising:

image holding means for holding an image that is formed of a developer, the image being intended to be transferred onto a medium, and an image that is not intended to be transferred onto a medium;

transfer means for transferring the image that is intended to be transferred onto a medium onto a medium; and forming means for forming, upon receiving a print instruction to form the image that is intended to be transferred onto a medium onto the image holding unit, the image that is not intended to be transferred onto a medium at a position on the image holding unit where the image that is intended to be transferred onto a medium is to be formed.

* * * * *